US005117223A

United States Patent [19]

Tanner

[11] Patent Number: 5,117,223

[45] Date of Patent: May 26, 1992

[54] COMBINATION PORTABLE ALARM SYSTEM AND STORAGE CONTAINER FOR PARTS THEREOF

[76] Inventor: Harry Tanner, 86 E. Cypress La., Westbury, N.Y. 11590

[21] Appl. No.: 312,211

[22] Filed: Feb. 17, 1989

[51] Int. Cl.[5] ..... G08B 13/00

[52] U.S. Cl. ..... 340/693; 312/240; 340/521; 340/541; 340/691; 358/108

[58] Field of Search ..... 340/693, 521, 541, 556, 340/546, 628, 691; 312/240; 358/108

[56] References Cited

U.S. PATENT DOCUMENTS

| | | | |
|---|---|---|---|
| 3,599,195 | 8/1971 | Boyko | 340/521 |
| 3,932,856 | 1/1976 | Tremont | 340/546 |
| 4,206,450 | 6/1980 | Harden et al. | 340/514 |
| 4,446,454 | 5/1984 | Pyle | 340/541 |
| 4,644,329 | 2/1987 | Brueske | 340/556 |
| 4,742,336 | 5/1988 | Hall et al. | 340/546 |

*Primary Examiner*—Glen R. Swann, III
*Attorney, Agent, or Firm*—Richard L. Miller

[57] ABSTRACT

A portable alarm system for a construction site or the like is provided with and consists of a cabinet, a stanchion supported on the cabinet, an alarm unit supported on the stanchion, and a key pad to program the alarm unit. When not in use the stanchion and alarm unit are stored within the cabinet.

6 Claims, 1 Drawing Sheet

COMBINATION PORTABLE ALARM SYSTEM AND STORAGE CONTAINER FOR PARTS THEREOF

BACKGROUND OF THE INVENTION

The instant invention relates generally to security systems and more specifically it relates to a portable alarm systems.

Numerous security systems have been provided in the prior art that are adapted to emit local or remote alarm signals in event of breach of security of a premises, such as a intrusion, fire or the like. For example, U.S. Pat. Nos. 3,599,195; 3,932,856; 4,206,450; 4,446,454 and 4,644,329 all are illustrative of such prior art. While these units may be suitable for the particular purpose to which they address, they would not be as suitable for the purpose of the present invention as hereafter described.

SUMMARY OF THE INVENTION

A primary object of the present invention is to provide a portable alarm system that will overcome the shortcomings of the prior art devices.

Another object is to provide a portable alarm system that is designed to function as a base station of an intruder and fire detection system where a permanent system is not practical and is also intended to be used temporarily to replace other systems which are out of service. The system is powered by either a 12 volt battery or conventional power supply when available.

An additional object is to provide a portable alarm system that is easily assembled and useful at construction sites and areas where temporarily stored valuables might otherwise go unprotected.

A yet additional object is to provide a portable alarm system in which relatively small valuables, such as cash, jewelry, expensive tools, etcetera may be locked within it's cabinet and thereby be protected both from the elements as well as thieves.

A further object is to provide a portable alarm system that is simple and easy to use.

A still further object is to provide a portable alarm system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figures 1, 2, 3, 4:
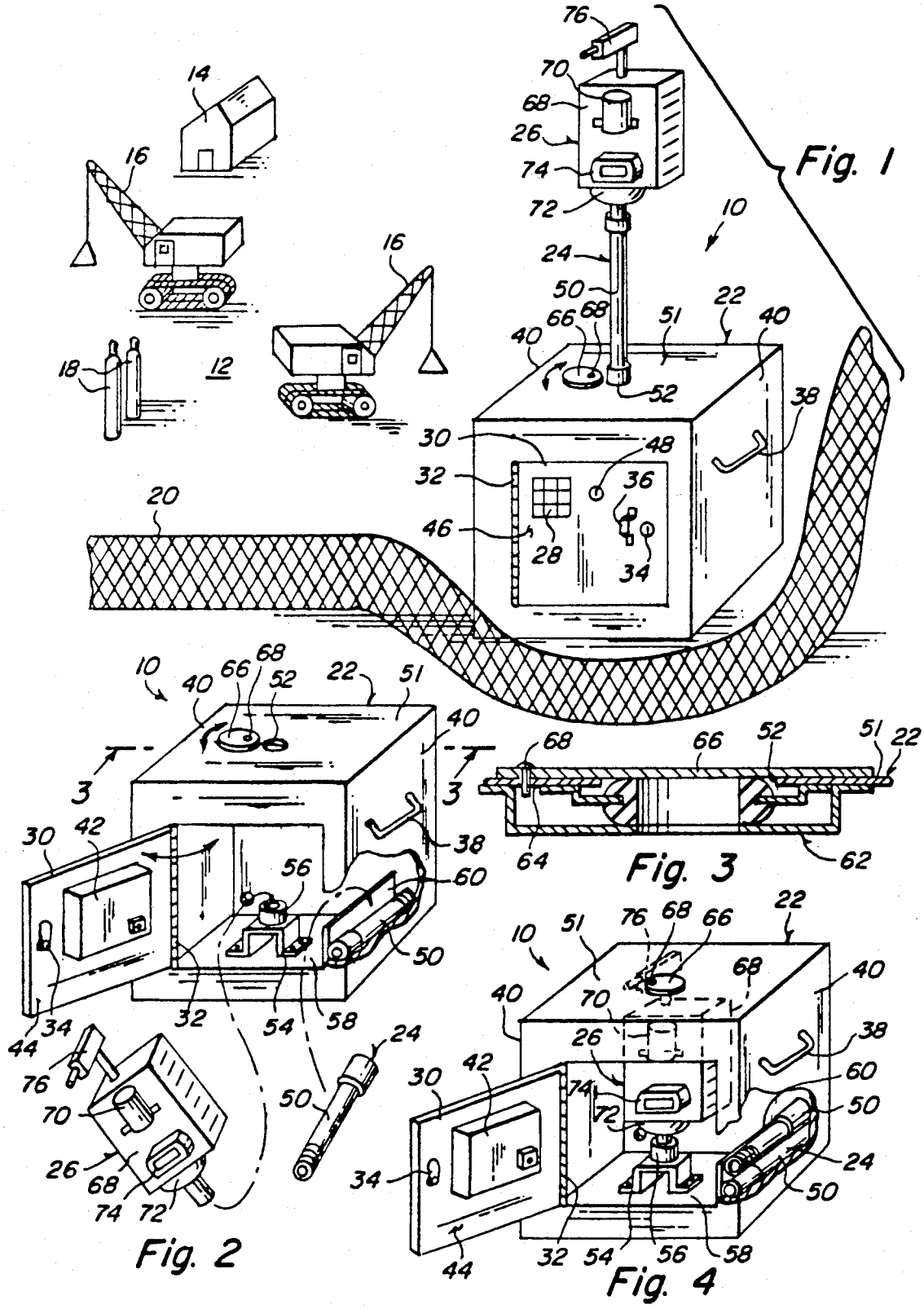
FIG. 1 is a perspective view of the invention shown set up and in use in the foreground of a typical construction site with various construction equipment in the back ground.
FIG. 2 is a perspective view of the cabinet with the door open, with parts broken away showing the internal structure and some parts being removed or stored therein.
FIG. 3 is a enlarged cross sectional view as indicated by line 3—3 in FIG. 2 showing the details of stanchion opening at the top of the cabinet.
FIG. 4 is another perspective view, similar to FIG. 2, of the cabinet open with parts broken away showing the internal structure with all the parts stored therein.

Turning now descriptively to the drawings, in which like reference characters denote like elements throughout the several views, FIGS. 1, 2 and 4 illustrate a portable alarm system 10 for a typical construction site, 12 and the like that may include a storage hut 14, cranes 16, gas tanks 18 and fence 20. The alarm system 10 includes a cabinet 22 which functions as a base for the alarm system when in use and a storage container when the alarm system is not in use, as well as a storage area for relatively small valuables, such as cash, jewelry, expensive tools, etcetera. A stanchion 24 is supported on the cabinet 22 when in use and controlled through the control box 42 by radio waves, and stored within the cabinet when not in use. An alarm unit 26 is supported on the stanchion 24 when in use and stored within the cabinet 22 when not in use. A Key pad 28 is on the cabinet 22 to program the alarm unit 26 as is known in the art.

A door 30 is hinged at 32 to the cabinet 22 for access into the cabinet. A door lock 34 is provided on the door 30 for securing the door in a closed position. A door handle 36 is for opening and closing the door and a pair of carrying handles 38 are each affixed onto opposite sides 40 of the cabinet 22 so as to make it convenient to transport the equipment between sites.

The cabinet 22 further contains an alarm control box 42 for controlling the alarm through known means mounted onto rear surface 44 of the door 30 with the key pad 28 mounted through front surface 46 of the door into the alarm control box 42. Contained in the control box is a 12 volt battery and a male plug for connection to ordinary power supply when available. A lock 48 is also mounted through the front surface 46 of the door 30 for securing a program card of the key pad 28, as is well known in the art.

The stanchion 24 includes a plurality of interconnecting pipes 50. The cabinet 22 has a top wall 51 with a central aperture 52 therein. A bracket 54 with a collar 56 is mounted to bottom 58 of the cabinet with the collar 56 in vertical alignment with the central aperture 52 in the top wall 51 in the cabinet. The lowermost pipe 50 of the stanchion 24 can be supported in the collar 56 when the alarm system 10 is in use and the alarm unit 26 can be supported in the collar 56 when the alarm system is not in use. A short partition wall 60 is mounted in the cabinet 22 forming a compartment so that the pipe sections 50 of the stanchion 24 can be stored therein when the alarm system 10 is not in use.

As best seen in FIG. 3 a gasket assembly 62 is mounted to underside 64 of the top wall 51 of the cabinet 22 below the central aperture 52 to prevent water from leaking inside the cabinet when the alarm system 10 is in use.

A lid 66 is affixed at 68 to the top wall 51 of the cabinet 22 so it can be swiveled to cover the central aperture 52 when the stanchion 24 is removed therefrom to prevent water leaking inside the cabinet when the alarm system 10 is not in use.

The alarm unit 26 may include a bell 68, a motion detector 70, a smoke detector 72, a spot light 74, a video camera 76 and the like as may be required by the individual owner's needs. The alarm system 10 can also support and store (not shown) a closed circuit TV Camera and portable video cassette recorder capable of operating on its own power supply or ordinary house current. It can also include a cellular telephone signal transmitter to transmit the alarm condition call to a cellular answering station and then on to the alarm monitoring station. The cabinet 12 can optionally have four caster type wheels so as to make the alarm system 10 easier to move from place to place.

The portable alarm system 10 is design to function as a base station of an intruder and fire detection system where a permanent system is not practical. It is easily assembled and useful at construction sites or areas where temporarily stored valuables might otherwise go unprotected. It is also intended to be used temporarily to replace other systems which are out of service. The electrical and alarm components used in the system are readily available at alarm retail outlets and hardware stores.

It should be clarified, that during both use and during storage, the alarm is both times supported by the bottom support 54. The hole 52 is a pass-through hole whereby the pipes 50 can extend upwardly from the support 54 and hold the alarm. However, in both cases the alarm is not supported from the top of the box but still supported from the same support 54.

Concerning the way that the control box 42 controls the alarm, it is believed that such controls can be in any standard way. For example, they can actually be hard wired with the wires extending from the control box 42 to the support 54 and the support 54 being conductive could conduct through the pipes 50 directly or through wires passing through the pipes and going to the alarm. Alternately, control can be through radio waves as is well known, with such controls being similar to garage door openers or any other type of remote control system which is wireless.

It is believed well known how to interconnect a control system to an alarm. It is either hard wired or wireless. It is believed that one skilled in the art need not have a description of the control and would clearly understand a common way of connecting wires from the control system to the alarm, as an alternative to a radio wave controlled system.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A portable alarm system for a construction site or the like, said alarm system comprising:

a) a cabinet which functions both as a base for said alarm system and as a safe for valuable when when said alarm system is in use and as a storage container for said alarm system when it is not in use, said cabinet having a top well with a central aperture therein; and further comprising:

i) a bracket with a collar, said bracket mounted to a bottom of said cabinet with said collar in vertical alignment with said central aperture in said top wall in said cabinet so that a lowermost pipe section of said stanchion can be supported in said collar when said alarm system is in use and said alarm unit can be supported in said collar when said alarm system is not in use, and ii) a short partition wall mounted in said cabinet forming a compartment so that said stanchion can be stored therein when said alarm system is not in use;

b) a stanchion supportable by said cabinet when in use and storable within said cabinet when not in use;

c) an alarm unit supportable outside said cabinet on said stanchion when in use and storable within said cabinet when not in use; and d) control means on said cabinet to control said alarm unit.

2. A portable alarm system as recited in claim 1 further comprising:

a) a gasket assembly mounted to the underside of said top wall below said central aperture to prevent water from leaking inside said cabinet when said alarm system is in use, and;

b) a lid affixed to said top wall of said cabinet so it can be swivelled to cover said central aperture when said stanchion is removed therefrom so as to prevent water from leaking inside of said cabinet when said alarm system is not in use.

3. A portable alarm system as recited in claim 1 wherein said alarm unit includes a bell, a motion detector, a smoke detector, a spot light, and a video camera, all positioned in said cabinet, and controlled by said control means whereby said cabinet functions as a storage container for secure storage of the components when the system is not in use, and a secure storage compartment for valuables and a base for the assembled stanchion and alarm components when the alarm system is in use.

4. A storage container and support unit for a portable alarm system and parts thereof, said storage container and support unit comprising:

a) a cabinet which functions both as a base for the alarm system and as a safe for valuable when the alarm system is in use and as a storage container for the alarm system when it is not in use, said cabinet having a top wall with a central aperture therein; and further comprising:

i) a bracket with a collar, said bracket mounted to a bottom of said cabinet with said collar in vertical alignment with said central aperture in said top wall in said cabinet so that a lowermost pipe section of said stanchion can be supported in said collar when said alarm system is in use and said alarm unit can be supported in said collar when said alarm system is not in use; and ii) a short partition wall mounted in said cabinet forming a compartment so that said stanchion can be stored therein when said alarm system is not in use;

b) a stanchion supportable by said cabinet when in use and storable within said cabinet when not in use;

c) an alarm unit supportable outside said cabinet on said stanchion when in use and storable within said cabinet when not in use; and d) control means on said cabinet to control said alarm unit.

5. A storage container and support unit as recited in claim 4 further comprising:

a) a gasket assembly mounted to the underside of said top wall below said central aperture to prevent water from leaking inside said cabinet when said alarm system is in use, and;

b) a lid affixed to said top wall of said cabinet so it can be swivelled to cover said central aperture when said stanchion is removed therefrom so as to prevent water from leaking inside of said cabinet when said alarm system is not in use.

6. A storage container and support unit as recited in claim 4 wherein said alarm unit includes a bell, a motion detector, a smoke detector, a spot light, a video camera, all positioned in said cabinet for control by said control means.

* * * * *